United States Patent [19]

Kikkawa et al.

[11] Patent Number: 4,593,835

[45] Date of Patent: Jun. 10, 1986

[54] CRYOGENIC LIQUEFIED PUMP SYSTEM

[75] Inventors: Seiichi Kikkawa, Katsuta; Hisanao Ogata; Yoshinori Hakuraku, both of Chiyoda; Masahiro Mase, Tochigi; Nobuo Tsumaki, Ushiku; Yoshihisa Awada; Hiroki Kajiwara, both of Kudamatsu, all of Japan

[73] Assignee: Hitachi, Ltd., Tokyo, Japan

[21] Appl. No.: 604,002

[22] Filed: Apr. 26, 1984

[30] Foreign Application Priority Data

Apr. 27, 1983 [JP] Japan ..... 58-72906

[51] Int. Cl.[4] ..... B67D 5/60; B67D 5/64

[52] U.S. Cl. ..... 222/131; 222/152; 222/183; 222/333; 62/55

[58] Field of Search ..... 222/333, 385, 131, 152, 222/183; 417/901; 62/55

[56] References Cited

U.S. PATENT DOCUMENTS

| | | | |
|---|---|---|---|
| 2,973,629 | 3/1961 | Lady | 62/55 |
| 3,112,049 | 11/1963 | Messer | 222/333 |
| 3,131,713 | 5/1964 | Kelley | 62/55 |
| 3,369,715 | 2/1968 | Carter | 222/333 |
| 3,399,691 | 9/1968 | Schoch et al. | 62/55 |
| 3,825,156 | 7/1974 | Nobuo | 222/333 |
| 3,876,120 | 4/1975 | Haesloop et al. | 222/333 |
| 3,938,347 | 2/1976 | Riedel et al. | 62/55 |
| 3,975,117 | 8/1976 | Carter | 417/901 |

*Primary Examiner*—Joseph J. Rolla
*Assistant Examiner*—P. McCoy Smith
*Attorney, Agent, or Firm*—Antonelli, Terry & Wands

[57] ABSTRACT

A cryogenic liquefied pump system which includes a pump having a drive motor, bearings, a drive shaft, and an impeller adapted to be disposed in a vessel storing a cryogenic liquid. An outer insulating tank is mounted in the vessel and an inner insulating tank is mounted inside the outer insulating tank, with a vacuum layer being interposed between the inner and outer insulating tanks. An inner side of the inner insulated tank, in which the motor and bearings are arranged, is maintained at a room temperature, with a tip portion of the inner insulating tank being formed into an outer case extending into a cryogenic region outside of the outer insulated tank.

10 Claims, 4 Drawing Figures

CRYOGENIC LIQUEFIED PUMP SYSTEM

BACKGROUND OF THE INVENTION

The present invention relates to a pump arrangement for supplying cryogenic liquefied gases such as, for example, liquid helium, nitrogen, hydrogen, and neon, and, more particularly, to a liquefied pump system for supplying liquid helium.

A cryogenic liquefied gas pump proposed in, for example, CRYOGENICS, L. B. Dinaburg et al, July 1977, pages 439–440, with the cryogenic liquefied gas pump including a motor disposed at an upper part of a storage tank for accommodating a liquefied gas or a cryostat, and with a driving shaft of the motor, extending into the tank, having an impeller connected at a lower end thereof. In the proposed liquefied gas pump, the motor is at an ambient room temperature and the pump impeller is at a very low temperature thereby resulting in a temperature differential due to a difference in thermal transmission by the driving shaft and a surrounding housing made of stainless steel.

A disadvantage of the above proposed cryogenic liquefied gas pump resides in the fact that the driving shaft is relatively long and, consequently, it is impossible to provide for a high speed rotation. Moreover, the overall construction of the proposed pump is very complicated.

Yet another disadvantage of the proposed liquefied gas pump resides in the fact that the bearings for the impeller are fashioned as ball bearings exposed to very low temperature liquefied gas and lubricated thereby. Consequently, the bearings are subjected to heavy wear thereby considerably shortening the life span thereof resulting in increased maintenance and repair costs as well as an increase in the number of times the pump must be taken off the line.

In, for example, NBSIR 75-816, July 1975, U.S. Department of Commerce, FIG. 1, a liquefied gas pump is proposed which employs a submerged driving motor and a short driving shaft.

However, disadvantages of the last mentioned liquefied gas pump reside in the fact that since the pump is located in a cryogenic region, the ball bearings are subjected to heavy wear with the attendant disadvantages noted above. Moreover, by subjecting the bearings to cryogenic temperatures, the overall realiability of the pump is relatively low and, with the motor disposed in the cryogenic region, the heat generated by the motor causes a thermal loss in the liquefied gas.

In, for example, U.S. Pat. Nos. 3,369,715 and 3,876,120, similar types of liquefied gas pumps submerged in cryogenic regions are proposed and, consequently, suffer from the above noted disadvantages.

The aim underlying the present invention essentially resides in eliminating the above-noted disadvantages of cryogenic liquefied gas pumps so as to provide a highly realiable compact liquefied gas pump.

In accordance with advantageous features of the present invention, a double insulated tank is formed inside a vessel for storing a liquefied gas so as to maintain an interior of the insulated tank at ambient room temperature, with a drive motor and associated bearings being unitarily accommodated in the interior of the insulated tank, and with an impeller of the pump, located in a very low temperature region, being driven by a drive motor.

In accordance with further features of the present invention, the driving shaft, housing, and insulated tank of the pump are cooled by a latent heat of vaporization during a gasification of a liquefied gas and the sensible heat of the gas at a low temperature so as to reduce the heat leakage to a very low temperature region from a room temperature region thereby enhancing the performance of the pump and preventing thermal deformation of the driving shaft and the housing so as to ensure a stable operation and an increase in the overall realiability of the pump.

Advantageously, in accordance with the present invention, a pump housing is provided for accommodating the motor, the bearings, and the drive shaft, with the pump housing being disposed inside the insulating tank and an outer case portion integrally formed at a lower end of the inner insulating tank.

Preferably, in accordance with the present invention, the bearing means are formed as self acting bearing means.

Additionally, in order to cool the liquefied gas pump by the liquefied gas, in accordance with yet further advantageous features of the present invention, a plurality of minute passage means are provided for enabling a flow of liquefied gas along surfaces of the driving shaft and the pump housing, with release apertures being provided for communicating the respective passages with an exterior of the vessel so as to enable the cryogenic liquid to cool the pump.

Advantageously, a regulator is provided at the respective release apertures for individually regulating a flow rate of the gas through the respective passages.

The passages may, in accordance with the present invention, be formed or defined between the driving shaft and a wall of the pump housing and the outer case portion as well as an inner wall of the inner insulating tank.

By virtue of the features of the present invention and, in particular, the provision of the double insulated tank structure, it is possible to maintain a room temperature zone inside of a cryogenic region of the liquefied gas and to readily utilize bearings which may be lubricated. Moreover, since the driving shaft may be shortened due to the relatively short distance between the drive motor and the impeller, the realiability of the pump is enhanced, a high speed rotation is possible, and a construction of the pump can be greatly simplified.

Additionally, with a double insulated tank structure, heat leakage to the cryogenic liquefied gas region can be prevented and vaporization of the liquefied gas can be minimized so that the pump is highly efficient and a stable operation of the pump is ensured.

Furthermore, since the double insulated tank and the pump housing for receiving the pump are, in accordance with the present invention, separately mounted, mainenance of the system is greatly facilitated since such separate mounting enables a simple detachment of the pump.

Additionally, by providing passages for enabling a flow of the liquefied gas, it is possible to conduct the liquefied gas through the passages or gaps between the driving shaft and the inside housing and between the outside housing and the inner insulated tank so as to enable a cooling of the pump.

Furthermore, by a separate or individual adjustment of the gas flow rates by gas release rate regulating means, it is possible to control the cooling so as to conform with the heat leakage of the respective parts thereby more efficiently reducing the heat leakage.

A further advantage of the present invention resides in the fact that the driving shaft, and the inner and outer sides of the housing as well as the inner insulating tank are uniformly cooled so that a positional deviation between the driving shaft and the housing or between the driving shaft and the inner insulating tank attributable to thermal deformation can occur thereby ensuring a stable operation of the cryogenic liquefied gas pumping system.

Additionally, the features of the present invention ensures that heat leakage, which includes heat generated during rotation of the drive motor in addition to heat attributed to conduction from room temperature parts, is minimized thereby also improving the performance of the system.

Accordingly, it is an object of the present invention to provide a cryogenic liquefied gas pumping system which minimizes if not avoids premature wear of the bearings thereof.

Another object of the present invention resides in providing a cryogenic liquefied gas pumping system which is simple in construction and therefore relatively inexpensive to manufacture.

A further object of the present invention resides in providing a cryogenic liquefied gas pumping system which functions realiably under all operating conditions.

Yet another object of the present invention resides in providing a cryogenic liquefied gas pumping system which ensures a highly realiable operation.

These and other objects, features, and advantages of the present invention will become more apparent from the following description when taken in connection with the accompanying drawings which show, for the purposes of illustration only, two embodiments in accordance with the present invention.

DETAILED DESCRIPTION

Figure 1:
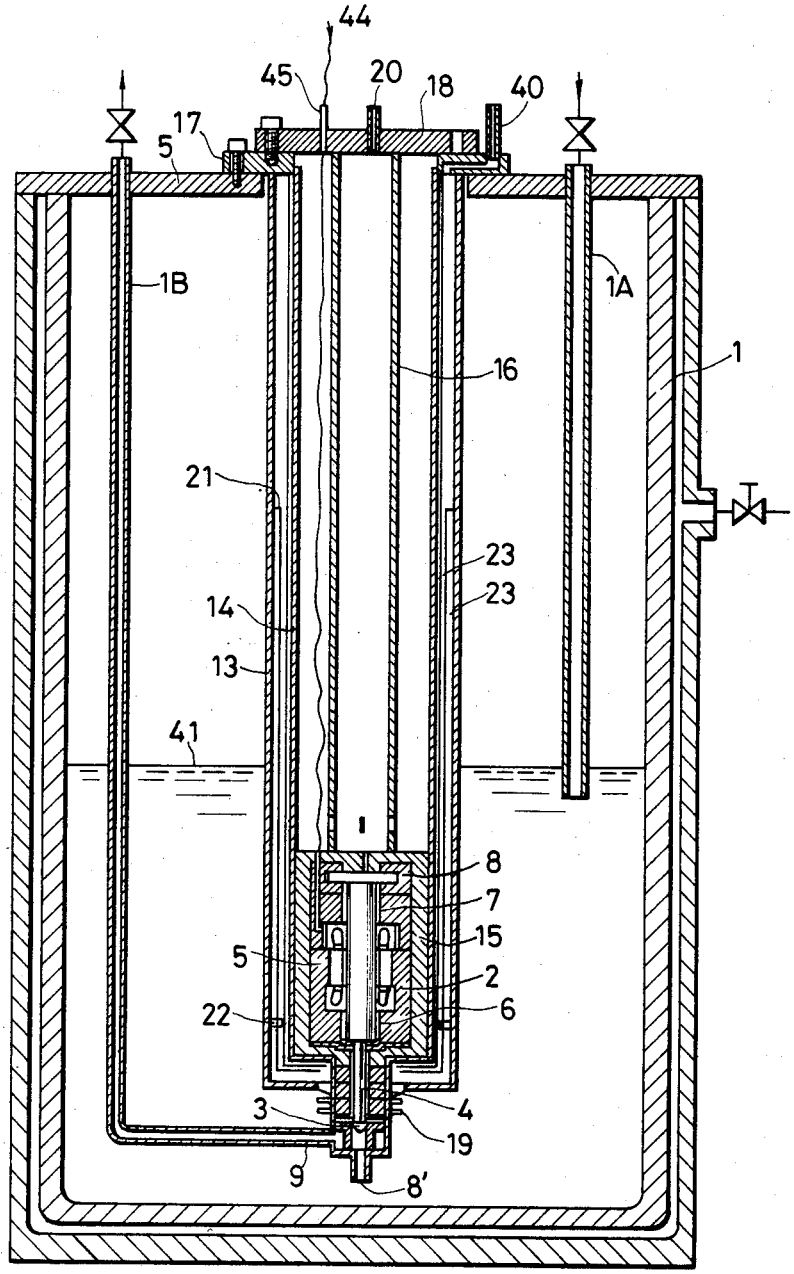
FIG. 1 is a vertical cross sectional view of a liquefied gas vessel equipped with a liquefied gas pump constructed in accordance with the present invention.

Referring not to the drawings wherein like reference numerals are used throughout the various views to designate like parts and, more particularly, to FIG. 1, according to this figure, a cryogenic vessel 1 such as, for example, a liquid helium storage tank or cryostat, is provided with a pipe 1*a* for feeding liquid helium into the vessel 1 and a pipe 1*b* for discharging the liquid helium. A pump 2 is provided which includes an impeller 3, a driving shaft 4, an electric motor 5, and bearings 6, 7, and 8. An outer insulating tank 13 has disposed therein an inner insulating tank 14 accommodating a pump housing 15. The temperature of the gas in the inner insulating tank 14 is in a room temperature region. The pump housing 15 has disposed therein the electric motor 5, driving shaft 4, and bearings 6, 7, and 8.

Upper parts or portions of the outer insulating tank 13 and the inner insulating tank 14 are fixed to a tank assembly flange 17, while lower ends thereof are fixed by bellows 19 so as to compensate for any possible positional deviations due to thermal shrinkage. A radiation shield 21 is disposed between the outer insulating tank 13 and the inner insulating tank 14, with a lower portion of the shield 21 being held by a spacer 22. Additionally, a multi-layer insulating material 23 is disposed around an inner surface of the outer insulating tank 3 and an outer surface of the inner insulating tank 14. An evacuating pipe 40 is provided in the flange 17 for enhancing an interspace between the inner and outer insulated tanks 14, 13, to be evacuated for a thermal insulation. The pump housing 15 is fixed to an upper flange 18 by a supporting pipe 16, with the flange 18 being provided with a vent tube 20 for venting helium gas produced by vaporization, along with a conduit 45 for accommodating leads 44 for the drive motor 5. The flange 17 is mounted on an upper plate 25 of the cryogenic vessel 1, and the flange 18, for enabling an assembling of the pump 2, is mounted on the insulated tank assembly flange 17. The pump 2 is mounted at a position such that the pump 2 is disposed at a position below a liquid level 41 of the liquid helium.

Figure 2:
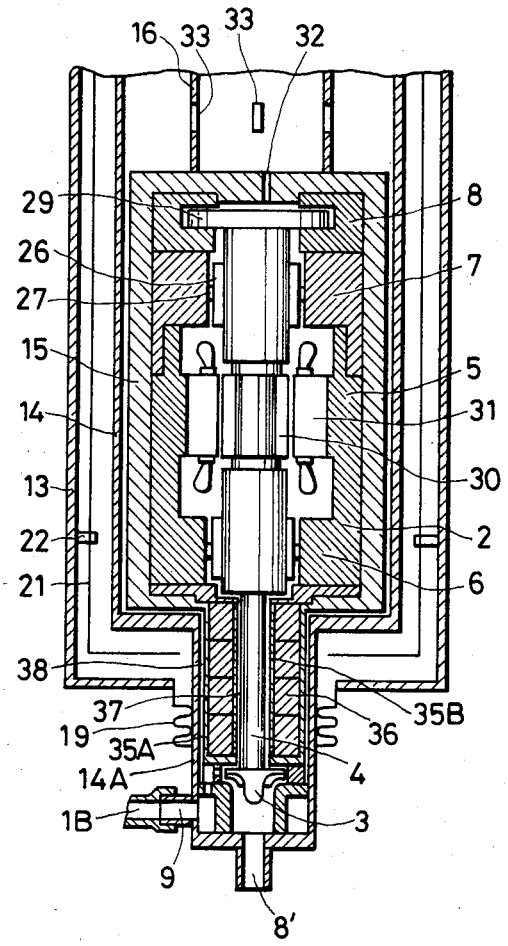
FIG. 2 is an enlarged cross-sectional view of a pump driving portion of the liquefied gas pump of FIG. 1.

As shown in FIG. 2, the impeller 3 is attached to the lower end of the driving shaft 4, with a rotor 30 of the drive motor 5 being mounted substantially centrally of the driving shaft 4, and with an upper end of the driving shaft 4 being formed into a disc 29 so as to provide for a thrust bearing. The stator 31 of the driving motor 5 is disposed in opposition to the rotor 30, and the journal bearings 6, 7 are respectively disposed above and below the rotor 30 and stator 31. The journal bearings 6, 7 are constructed as tilting pad type self-acting gas bearings which include a tilting pad 26 supported by a pivot 27, with the thrust bearing 8 also being formed as a self-acting gas bearing. A shaft case 35B and an inner case 35A are disposed around the driving shaft 4, and a solid insulating material 36 such as, for example, foamed polyethylene, is disposed in an interspace between the shaft case 35B and the inner case 35A, with an outer case portion 14A, unitarily formed with the insulated tank 14, receiving or accommodating the inner case 35A. An abrupt temperature distribution or differential is established in the area of the pump 2 because the lower end thereof is in contact with the liquid helium and the upper end is exposed to a temperature near room temperature. The elements of the pump 2, except for the impeller 3 are received in the pump housing 15 and the inner case 35A.

When the stator 31 of the motor 5 is energized so as to rotate the impeller 3 of the pump 2, liquid helium is drawn by suction through a suction port 8' and is delivered through passages 3*a*, 3*b* to a discharge port 9 communicating with a discharge pipe 1B for supplying the liquid helium to a load (not shown). Liquid helium not drawn off through the suction port 8' rises along an annular minute passage or gap 37 formed between the driving shaft 4 and the shaft case 35B and/or between the driving shaft 4 and the bearings 6, 7, and 8 and along an annular minute gap or passage 38 formed between the outer case portion 14*a* and the inner case 35A and/or between the space between the inner insulated tank 14 and the housing 15, with the helium being vaporized substantially midway through the gaps or spaces. The vaporized helium gas from around the driving shaft, along the annular minute gap or passage 38, and between the inner insulating tank 14 and pump housing 15 are released through the supporting pipe 16 through a release aperture 32, provided in the upper part of the pump housing 15, and through a release aperture 33 provided in a lower part of the supporting pipe 16. Additionally, in order to eliminate the heat generated by the drive motor 5, it is also possible to pass a coolant such as, for example, cooling water through a cooling jacket or cooling pipe disposed on or around a peripheral wall portion of the pump housing 15.

By virtue of the fact that a room temperature zone can be maintained inside the liquid helium temperature region through the use of an outer insulating tank 13 and the inner insulating tank 14, it is possible to use self acting gas bearings for the pump 2. Consequently, there is no danger of contamination of the helium gas so that the realiability of the pump 2 can be considerably enhanced.

Figure 3:
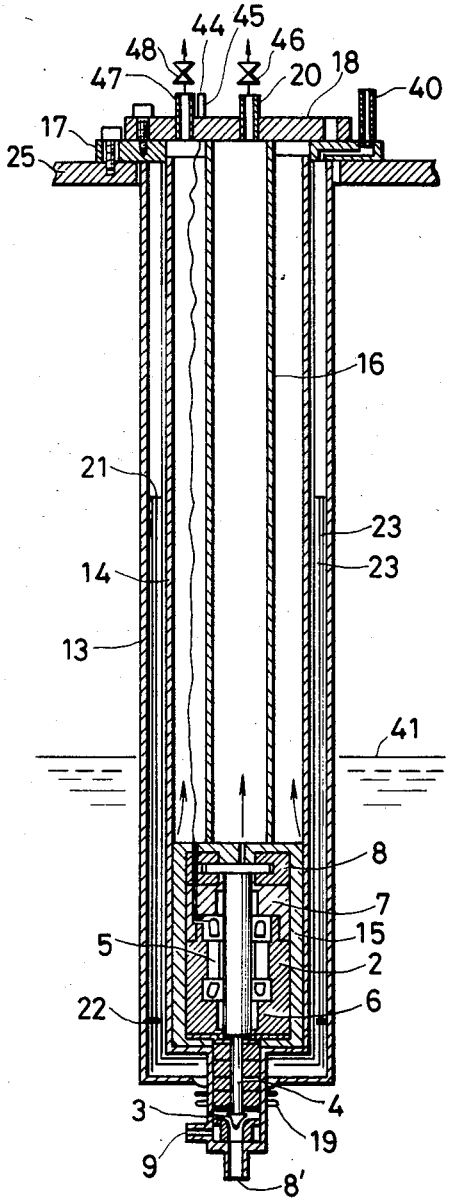
FIG. 3 is a vertical cross-sectional view of a liquefied gas pump constructed in accordance with another embodiment of the present invention.
Figure 4:
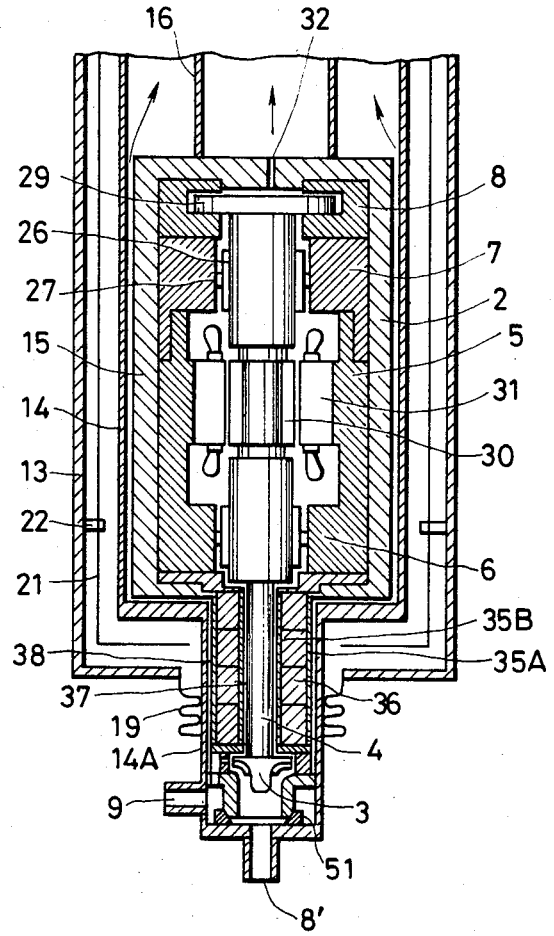
FIG. 4 is an enlarged cross-sectional view of a pump driving portion of the liquefied gas pump of FIG. 3.

In the embodiment of FIGS. 3 and 4, as with the embodiment of FIGS. 1 and 2, the liquid helium, drawn by suction created by the impeller 3 and entering into the annular minute gap or passage 37 around the driving shaft 4, is vaporized by heat leakage from the upper part of the pump 2 and helium gas rises along the minute gap or passage 37 between the driving shaft 4 and the bearing 6, the stator 31 and the bearings 7 and 8, and is released out of the system through the release aperture 32, the supporting pipe, and the vent tube 20. However, in the embodiment of FIGS. 3 and 4, the flow of helium gas through the vent tube 20 is controlled by a flow rate regulator valve 46. Likewise, the liquid helium entering from the lower part of the pump 2 into the annular minute gap or passage 38, defined between the inner case 35A and the inner insulated tank 14, is vaporized in the lower portion of the insulating material 36 by heat leakage, and the helium gas is released through the interior of the inner insulating tank 14 and the vent tube 47, with the flow of the helium gas being controlled by the flow rate regulator valve 48. The helium gas produced by the vaporization in the low temperature region within the gaps or passages 37, 38 cools the pump 2 and the pump housing 15 as the gas rises along the respective gaps or passages 37, 38. The quantity of helium gas to flow out of the vent tubes 20, 47 may be adjusted in correspondence with the quantities of heat leakage due to thermal conduction through the driving shaft 4 and a driving shaft side of the pump housing 13, as well as the heat leakage due to thermal conduction through the outside housing and the inner insulating tank 14.

It has been experimentally determined that by individually adjusting or regulating the flow rates of the flow rate regulator valves 46, 48 in a range of 1:5 to 1:50 to control the flow rate of the helium gas rising along the gaps or passages 37, 38, it is possible to obtain a very stable operation of the pump 2 so as to reduce the heat leakage and also to uniformly cool the driving shaft 4, the pump housing 15, and the inner insulating tank 14.

Since the pump 2 is of a unitary structure, in order to ensure a sealed structure which withstands the fluid pressure difference between the suction port 8' and the discharge port 9, as shown most clearly in FIG. 4, a seal ring 51 made of a plastic material may be detachably mounted at a tip end of the pump housing 15 thereby enabling a compensation of dimensional errors in machining as well as installation errors involved when the pump housing 15, with the pump 2 received therein, is inserted into the inner insulating tank 14 from above and adjustments at the installation are facilitated. Additionally, in accordance with the present invention, the maintenance including the repair of the sealed portions due to deterioration is facilitated because an exchange of the seal ring 51 is relatively easy.

While we have shown and described two embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. A cryogenic liquefied pump system adapted to be disposed in a vessel storing a cryogenic liquid, the system comprising:

an outer insulating tank adapted to be mounted in the vessel, an inner insulating tank disposed inside the outer insulating tank, said inner and outer insulating tanks being dimensioned such that a space is provided between an outer peripheral surface of the inner insulating tank and an inner peripheral surface of the outer insulating tank, means for enabling an evacuation of the space between the inner and outer insulating tanks so as to form a room temperature region in an interior of the inner insulating tank, a pump means for discharging the cryogenic liquid from the vessel, the pump means including drive motor means having a driving shaft means, an impeller means mounted on said driving shaft means, and bearing means for rotatably supporting said drive shaft means, said inner insulating tank means including an outer case portion disposed in a cryogenic region of the vessel outside of the outer insulating tank, means are provided for mounting said pump means such that said drive motor and said bearing means are disposed in the room temperature region of the inner insulating tank, and wherein said impeller means is disposed in the outer case portion.

2. A cryogenic liquefied gas pump system according to claim 1, further comprising a pump housing means for accommodating said motor, said bearing means, and said driving shaft means, said pump housing means being disposed inside said inner insulating tank and said outer case portion.

3. A cryogenic liquefied gas pump system according to claim 2, wherein said bearing means are self-acting gas bearing means.

4. A cryogenic liquefied gas pump system according to claim 2, wherein a plurality of passage means are provided for enabling a flow of liquefied gas along surfaces of said driving shaft means and said pump housing means, and wherein release means are provided for communicating the respective passage means with an exterior of the vessel so as to enable the cryogenic liquid to cool said pump means.

5. A cryogenic liquefied gas pump system according to claim 4, wherein regulating means are provided at the respective release means for individually regulating a flow rate of the gas through the respective passage means.

6. A cryogenic liquefied gas pump system according to claim 4, wherein said passage means are provided at least between said driving shaft means and a wall of said pump housing means and between an outer wall of said pump housing means and said outer case portion and an inner wall of said inner insulating tank.

7. A cryogenic liquefied gas pump system according to claim 1, wherein means are provided along at least said outer case portion for compensating for thermal deformation.

8. A cryogenic liquefied gas pump system according to claim 1, wherein insulation means are disposed in the space between the inner and outer insulating tanks.

9. A cryogenic liquefied gas pump system according to claim 1, wherein said means for mounting said pump means includes a support means connected to said pump means, and flange means connected to said pump means and adapted to be mounted on the vessel.

10. A cryogenic liquefied gas pump system according to claim 9, wherein a further flange means is provided for mounting said inner and outer insulating tanks in the vessel, said means for enabling evacuation of the space between the inner and outer insulating tanks being disposed in said further flange means.

* * * * *